US010538988B2

(12) United States Patent
Pabon

(10) Patent No.: US 10,538,988 B2
(45) Date of Patent: Jan. 21, 2020

(54) EXPANDABLE DOWNHOLE SEAT ASSEMBLY

(71) Applicant: Schlumberger Technology Corporation, Sugar Land, TX (US)

(72) Inventor: Jahir Pabon, Newton, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 146 days.

(21) Appl. No.: 15/169,218

(22) Filed: May 31, 2016

(65) Prior Publication Data

US 2017/0342795 A1 Nov. 30, 2017

(51) Int. Cl.

| | |
|---|---|
| ***E21B 33/128*** | (2006.01) |
| ***E21B 34/06*** | (2006.01) |
| ***E21B 23/01*** | (2006.01) |
| *E21B 34/00* | (2006.01) |

(52) U.S. Cl.

CPC ..... *E21B 33/128* (2013.01); *E21B 23/01* (2013.01); *E21B 34/06* (2013.01); *E21B 2034/007* (2013.01)

(58) Field of Classification Search

CPC ..... E21B 23/01; E21B 33/128

See application file for complete search history.

(56) References Cited

U.S. PATENT DOCUMENTS

| | | | |
|---|---|---|---|
| 2,315,931 | A | 4/1943 | Burt et al. |
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |
| 4,064,937 | A | 12/1977 | Barrington |
| 4,292,988 | A | 10/1981 | Montgomery |
| 4,341,272 | A | 7/1982 | Marshall |
| 4,355,686 | A | 10/1982 | Arendt |
| 4,372,384 | A | 2/1983 | Kinney |
| 4,499,951 | A | 2/1985 | Vann |
| 4,729,432 | A | 3/1988 | Helms |
| 4,771,831 | A | 9/1988 | Pringle et al. |

(Continued)

FOREIGN PATENT DOCUMENTS

| | | | |
|---|---|---|---|
| GB | 2485004 | A | 5/2012 |
| WO | 2003095794 | A1 | 11/2003 |

(Continued)

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — Caroline N Butcher

(57) ABSTRACT

An apparatus that is usable with a well includes an inner ring, an outer ring and a tool assembly. The inner ring includes a seat to receive an untethered object; the outer ring is concentric with the inner ring; and the tool assembly, downhole in the well, engages the outer ring with the inner ring to press the outer ring into a wall of a tubing string to secure the outer ring to the tubing string.

18 Claims, 15 Drawing Sheets

(56) References Cited

U.S. PATENT DOCUMENTS 4,967,853 A 11/1990 Landry
5,069,280 A 12/1991 McKee et al.
5,183,114 A 2/1993 Mashaw, Jr. et al.
5,207,274 A 5/1993 Streich et al.
5,224,044 A 6/1993 Tamura et al.
5,295,393 A 3/1994 Thiercelin
5,333,692 A 8/1994 Baugh et al.
5,526,888 A 6/1996 Gazewood
5,845,712 A 12/1998 Griffith
5,921,318 A 7/1999 Ross
5,988,285 A 11/1999 Tucker et al.
6,006,838 A 12/1999 Whiteley et al.
6,059,032 A 5/2000 Jones
6,155,342 A 12/2000 Oneal et al.
6,155,350 A 12/2000 Melenyzer
6,206,095 B1 3/2001 Baugh
6,216,785 B1 4/2001 Achee, Jr. et al.
6,220,356 B1 4/2001 Spikes
6,302,199 B1 10/2001 Hawkins et al.
6,334,486 B1 1/2002 Carmody et al.
6,349,766 B1 2/2002 Bussear et al.
6,371,208 B1 4/2002 Norman et al.
6,443,228 B1 9/2002 Aronstam et al.
6,543,538 B2 4/2003 Tolman et al.
6,634,429 B2 10/2003 Henderson et al.
6,907,936 B2 6/2005 Fehr et al.
6,997,263 B2 2/2006 Campbell et al.
7,036,582 B2 5/2006 Cook et al.
7,066,285 B2 6/2006 Surjaatmadja
7,093,664 B2 8/2006 Todd et al.
7,096,954 B2 8/2006 Weng et al.
7,108,067 B2 9/2006 Themig et al.
7,114,559 B2 10/2006 Sonnier et al.
7,128,146 B2 10/2006 Baugh et al.
7,134,505 B2 11/2006 Fehr et al.
7,168,494 B2 1/2007 Starr et al.
7,210,533 B2 5/2007 Starr et al.
7,322,417 B2 1/2008 Rytlewski et al.
7,325,617 B2 2/2008 Murray
7,350,582 B2 4/2008 McKeachnie et al.
7,353,879 B2 4/2008 Todd et al.
7,377,321 B2 5/2008 Rytlewski
7,387,165 B2 6/2008 Lopez de Cardenas et al.
7,431,091 B2 10/2008 Themig et al.
7,464,764 B2 12/2008 Xu
7,490,669 B2 2/2009 Walker et al.
7,552,779 B2 4/2009 Fu et al.
7,543,634 B2 6/2009 Fehr et al.
7,543,647 B2 6/2009 Walker
7,549,469 B2 6/2009 Garcia
7,571,765 B2 8/2009 Themig
7,575,062 B2 8/2009 East, Jr.
7,628,210 B2 12/2009 Avant et al.
7,661,481 B2 2/2010 Todd et al.
7,669,665 B2 3/2010 Millet et al.
7,673,677 B2 3/2010 King et al.
7,748,460 B2 7/2010 Themig et al.
7,775,279 B2 8/2010 Marya et al.
7,798,236 B2 9/2010 McKeachnie et al.
7,832,472 B2 11/2010 Themig
7,874,365 B2 1/2011 East, Jr. et al.
7,891,774 B2 2/2011 Silverbrook
8,201,631 B2 6/2012 Stromquist et al.
8,211,247 B2 7/2012 Marya et al.
8,215,401 B2 7/2012 Braekke et al.
8,261,751 B2 9/2012 Kawano et al.
8,261,761 B2 9/2012 Gerrard et al.
9,528,336 B2 12/2016 Jacob et al.
2003/0155118 A1 8/2003 Sonnier et al.
2003/0180094 A1 9/2003 Madison
2004/0020643 A1 2/2004 Thomeer et al.
2004/0035586 A1 2/2004 Gudmestad et al.
2004/0118564 A1 6/2004 Themig et al.
2004/0163820 A1 8/2004 Bishop
2004/0262016 A1 12/2004 Farquhar
2006/0124310 A1 6/2006 Lopez de Cardenas et al.
2006/0131031 A1 6/2006 McKeachnie et al.
2006/0207764 A1 9/2006 Rytlewski
2006/0243455 A1 11/2006 Telfer et al.
2007/0044958 A1 3/2007 Rytlewski et al.
2007/0107908 A1 5/2007 Vaidya et al.
2007/0181224 A1 8/2007 Marya et al.
2007/0181304 A1 8/2007 Rankin et al.
2007/0272413 A1 11/2007 Rytlewski et al.
2007/0284097 A1 12/2007 Swor et al.
2008/0105438 A1 5/2008 Jordan et al.
2008/0210429 A1 9/2008 McMillin et al.
2009/0044955 A1 2/2009 King et al.
2009/0056934 A1 3/2009 Xu
2009/0159289 A1 6/2009 Avant et al.
2009/0178808 A1 7/2009 Williamson
2009/0255674 A1 10/2009 Boney et al.
2010/0101803 A1 4/2010 Clayton et al.
2010/0101806 A1 4/2010 Millet et al.
2010/0132954 A1 6/2010 Telfer
2010/0209288 A1 8/2010 Marya
2010/0212886 A1 8/2010 Hall et al.
2010/0252280 A1 10/2010 Swor et al.
2010/0282469 A1 11/2010 Richard et al.
2011/0056692 A1 3/2011 Lopez de Cardenas et al.
2011/0127047 A1 6/2011 Themig et al.
2011/0192607 A1 8/2011 Hofman et al.
2011/0240315 A1 10/2011 McNeilly
2011/0278010 A1 11/2011 Fehr et al.
2011/0284232 A1 11/2011 Huang
2011/0290506 A1 12/2011 Ocalan
2011/0308817 A1 12/2011 Ravensbergen
2012/0067583 A1 3/2012 Zimmerman et al.
2012/0085538 A1 4/2012 Guerrero et al.
2012/0145378 A1 6/2012 Frazier
2012/0145382 A1 6/2012 Braekke et al.
2012/0168163 A1 7/2012 Bertoja et al.
2012/0199341 A1 8/2012 Kellner et al.
2012/0199349 A1 8/2012 Themig et al.
2012/0227973 A1 9/2012 Hart et al.
2012/0261115 A1 10/2012 Xu
2012/0305236 A1 12/2012 Gouthaman
2013/0062063 A1 3/2013 Baihly et al.
2014/0014371 A1 1/2014 Jacob et al.
2014/0151054 A1 6/2014 Norrid
2014/0216758 A1 8/2014 Jacob et al.
2014/0216759 A1 8/2014 Jacob et al.
2015/0101825 A1* 4/2015 Jacob ..... E21B 34/063 166/376

FOREIGN PATENT DOCUMENTS

WO 2004088091 A1 10/2004
WO 2009023519 A1 2/2009
WO 2011006173 A2 1/2011
WO 2012174101 A2 12/2012

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

International Search Report and Written Opinion issued in related PCT application PCT/US2014/012711 dated May 21, 2014, 14 pages.

International Search Report and Written Opinion issued in related PCT application PCT/US2014/012740 dated May 7, 2014, 17 pages.

International Search Report and Written Opinion issued in related PCT application PCT/US2012/052214 dated Jan. 31, 2013, 10 pages.

(56) References Cited

OTHER PUBLICATIONS

PCT/US2014/012720, International Search Report and Written Opinion, dated Apr. 22, 2014, 10 pgs.
PCT/US2014/012731, International Search Report and Written Opinion, dated May 15, 2014, 14 pgs.
U.S. Appl. No. 14/029,918, Non-Final Office Action dated Mar. 14, 2016, 17 pgs.
U.S. Appl. No. 14,029,936, Non-Final Office Action dated Mar. 10, 2016, 10 pgs.
U.S. Appl. No. 14/029,958, Non-Final Office Action dated Mar. 4, 2015, 8 pgs.
U.S. Appl. No. 14/029,958, Final Office Action dated Nov. 3, 2015, 10 pgs.
U.S. Appl. No. 14/029,958, Non-Office Action dated Apr. 12, 2016, 6 pgs.
U.S. Appl. No. 14/029,936, Final Office Action dated May 16, 2017, 6 pgs.
Australian Examination Report for corresponding Australian Application Serial No. 201412745, dated Mar. 31, 2017, 3 pages.
Office Action issued in related U.S. Appl. No. 14/269,304 dated Jul. 10, 2018, 14 pages.
Exam Report issued in related GC Patent Application No. P/2014/28322 dated Feb. 26, 2018, 4 pages.
Office Action issued in related U.S. Appl. No. 14/029,897 dated Oct. 15, 2015, 13 pages.

* cited by examiner

EXPANDABLE DOWNHOLE SEAT ASSEMBLY

BACKGROUND

For purposes of preparing a well for the production of oil or gas, at least one perforating gun may be deployed into the well via a conveyance mechanism, such as a wireline, slickline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools (perforating guns, sleeve valves, and so forth). A given downhole tool may be actuated using a wide variety of techniques, such dropping a ball into the well sized for a seat of the tool; running another tool into the well on a conveyance mechanism to mechanically shift or inductively communicate with the tool to be actuated; pressurizing a control line; and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, a technique that is usable with a well includes deploying an assembly into a previously installed tubing string. The assembly includes a first ring and a second ring that is concentric with the first ring. The technique includes engaging the first ring with the second ring to press the first ring into the tubing string to secure the assembly to the string; receiving an untethered object in a seat of the second ring to form a fluid barrier; and using the fluid barrier to perform a downhole operation. In accordance with another example implementation, an apparatus that is usable with a well includes an an inner ring, an outer ring and a tool assembly. The inner ring includes a seat to receive an untethered object; the outer ring is concentric with the inner ring; and the tool assembly, downhole in the well, engages the outer ring with the inner ring to press the outer ring into a wall of a tubing string to secure the outer ring to the tubing string.

In accordance with yet another example implementation, a system that is usable with a well includes a tubing string; and an assembly that includes a setting tool and an expandable downhole seat assembly. The downhole seat assembly is adapted to be run downhole inside a central passageway of the tubing string in a radially contracted state of the downhole seat assembly. The downhole seat assembly includes a monolithic inner ring and an outer segmented ring assembly that is concentric with the inner ring. The setting tool assembly is adapted to axially translate the inner ring into the outer segmented ring assembly to, downhole in the well, radially expand the outer segmented ring assembly to secure the downhole seat assembly to the tubing string. The inner ring includes a seat to receive an untethered object to form a downhole fluid barrier in the tubing string.

Advantages and other features will become apparent from the following drawings, description and claims.

DETAILED DESCRIPTION

Figure 1A:
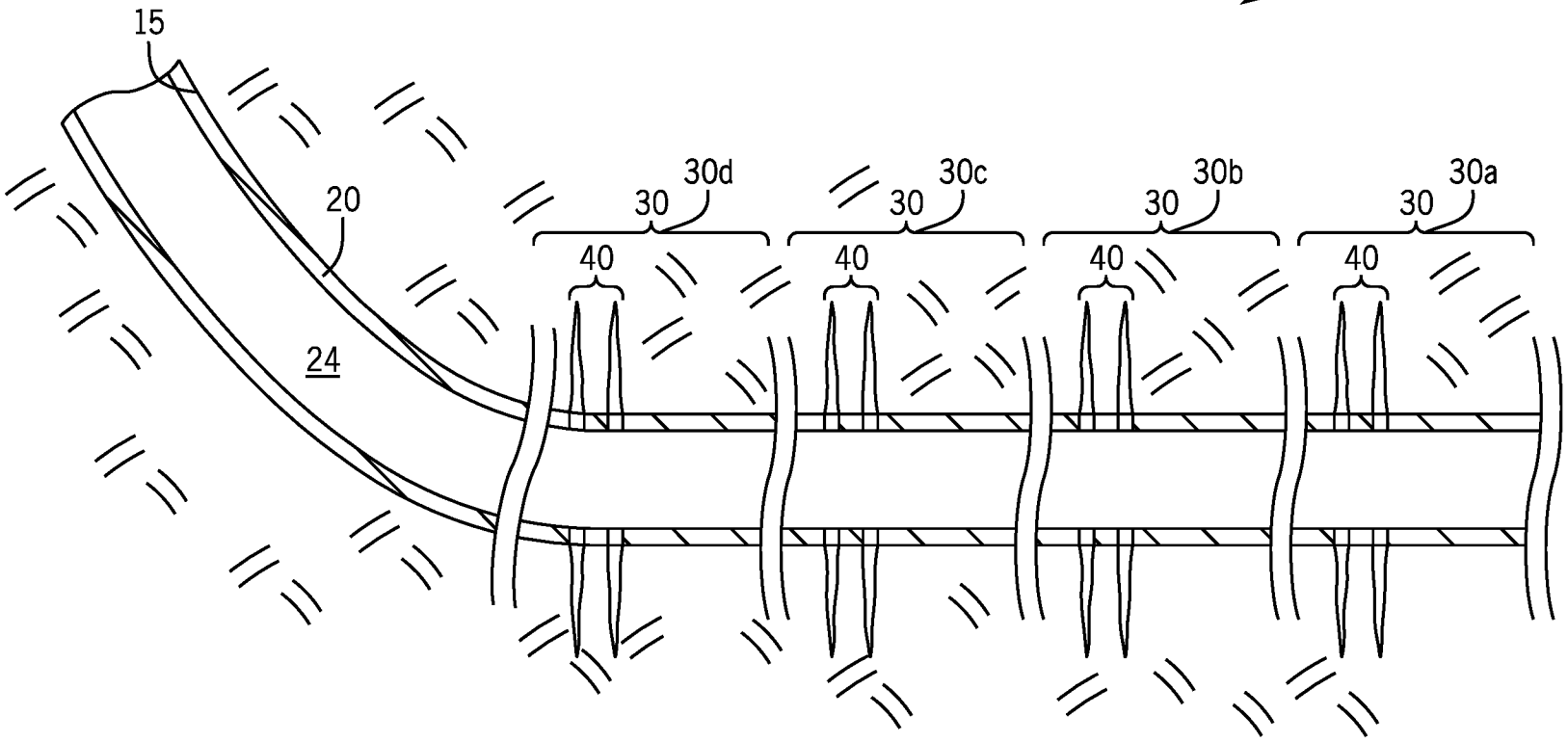
FIG. 1A is a schematic diagram of a well illustrating a perforated casing string according to an example implementation.

In general, systems and techniques are disclosed herein to deploy and use an expandable seat assembly (herein called the "expandable downhole seat assembly" or the "downhole seat assembly") in a tubing string for purposes of forming a fluid obstruction, or barrier, in the tubing string. The fluid barrier may be used in connection with any of number of downhole operations, such as stimulation operations, perforating operations, and so forth.

More specifically, the downhole seat assembly may be run downhole (in a radially contracted state) in a central passageway of an outer tubing string (a casing string, for example) until the assembly reaches a desired, or target, location at which the fluid barrier is to be formed. In this manner, the target location may be an arbitrary location of the tubing string, which is not associated with any particular feature of the tubing string, or the target location may be a location of the tubing string, which contains a specific feature (a shoulder or upset of the tubing string or a sleeve valve assembly of the tubing string, as examples). When positioned at the target location, the downhole seat assembly may then be radially expanded, as described herein, to secure the assembly to the tubing string. The downhole seat assembly has an object catching seat, so that an object may be deployed into the well to land on the seat to form the fluid barrier.

In accordance with example implementations, the downhole seat assembly includes concentric rings: an inner ring that contains the object catching seat; and an outer ring that is radially expanded to secure the seat assembly to the outer tubing string. In accordance with example implementations, the inner ring may be disposed downhole relative to the outer ring, such that the outer ring is disposed at a farther location from the Earth surface than the inner ring. As described further herein, the downhole seat assembly may be assembled on a setting tool assembly and run downhole inside a central passageway of the outer tubing string on a conveyance mechanism (a tubing string, wireline, slickline, and so forth). When the downhole seat assembly is at the target location, the setting tool assembly may then be operated to axially translate the inner ring relative to the outer ring (i.e., move the inner ring along the longitudinal axis of the string toward the outer ring) to cause the inner ring to engage and radially expand the outer ring to anchor the outer ring to the tubing string wall. The conveyance mechanism and setting tool assembly may then be withdrawn from the well (pulled out of hole), leaving the installed, or set, downhole seat assembly in the well.

In accordance with example implementations, the inner ring has a seat that is sized to catch an untethered object, which may be deployed from the Earth surface inside the central passageway of the outer tubing string. In this manner, the untethered object may travel through the central passageway of the outer tubing string and land in the seat of the inner ring for purposes of forming a downhole fluid barrier. The resulting fluid barrier, in turn, may be used to divert fluid uphole of the barrier for purposes of performing a downhole operation (a hydraulic fracturing operation that involves diverting fluid into the surrounding formation, an operation that involves shifting a sleeve valve, an operation that involves actuating a tubing pressure conveyed (TCP) downhole tool, and so forth).

In the context of this application, an "untethered object" refers to an object that is communicated downhole through a passageway of a string along at least part of its path without the use of a conveyance line (a slickline, a wireline, a coiled tubing string and so forth). As examples, the untethered object may be a ball (or sphere), a dart or a bar. The untethered object may be deployed from the Earth surface or deployed from a downhole tool (depending on the particular implementation), resulting in the object traveling inside the tubing string and landing in the seat of the downhole seat assembly.

In accordance with example implementations that are discussed herein, the downhole seat assembly has a radially contracted state (its run-in-hole state) and a radially expanded state (its state when secured or anchored in place downhole). In this manner, in accordance with example implementations, the outer ring may be the radially largest component of the downhole seat assembly and may have an overall outer diameter (OD), which is sufficiently small enough to freely pass through the central passageway of the outer tubing string while the downhole seat assembly is being run into the well. After the downhole seat assembly and its associated setting tool assembly reach the target downhole location, the setting tool assembly may be actuated to axially translate the inner ring into the outer ring to cause the outer ring to radially expand, as further described herein. This radial expansion of the outer ring, in turn, secures the outer ring to outer tubing string. As examples, the outer surface of the expanded outer ring may be secured to the inner wall surface of the outer tubing string due to friction and/or engagement of teeth of the outer ring with the outer tubing string; or, in accordance with further example implementations, an upset, shoulder, restriction, annular recess, or other feature of the outer tubing string may retain the expanded outer ring (and downhole seat assembly) in place.

In accordance with implementations that are discussed below, at least one of the inner and outer rings may be a segmented ring assembly, which has arcuate sections that are arranged in multiple layers. These layers are constructed to simultaneously radially expand and longitudinally contract to form a single layer ring, as further described herein. For example implementations that are discussed herein, the outer ring may be a segmented ring assembly; and the inner ring may or may not be a segmented ring assembly. Moreover, as discussed herein, in accordance with some implementations, the inner ring may be a non-segmented single piece, or monolithic, ring, which has a fixed overall OD.

In general, the segmented ring assembly has two states: a collapsed, or unexpanded state, which allows the ring assembly to have a smaller cross-section, or outer OD; and an expanded state in which the ring assembly has an expanded OD. As described further herein, depending on whether the segmented ring assembly is used for the outer ring or for the inner ring, the ring assembly may form an object catching seat when expanded (for the inner ring) and may contain features to grip into the wall of the outer tubing string (for the outer ring).

Referring to FIG. 1A, as a more specific example, in accordance with some implementations, a well 10 includes a wellbore 15, which traverses one or more hydrocarbon-bearing formations. As an example, the wellbore 15 may be lined, or supported, by a tubing string 20 (also called an "outer tubing string 20" herein), as depicted in FIG. 1A. The tubing string 20 may be cemented to the wellbore 15 (such wellbores are typically referred to as "cased hole" wellbores); or the tubing string 20 may be secured to the surrounding formation(s) by packers (such wellbores typically are referred to as "open hole" wellbores). In general, the wellbore 15 may extend through multiple zones, or stages 30 (four example stages 30*a*, 30*b*, 30*c* and 30*d*, being depicted in FIG. 1), of the well 10.

It is noted that although FIG. 1A depicts a lateral wellbore, the techniques and systems that are disclosed herein may likewise be applied to vertical wellbores. Moreover, in accordance with some implementations, the well 10 may contain multiple wellbores, which contain tubing strings that are similar to the illustrated tubing string 20 of FIG. 1A. The well 10 may be a subsea well or may be a terrestrial well, depending on the particular implementations. Additionally, the well 10 may be an injection well or may be a production well. Thus, many implementations are contemplated, which are within the scope of the appended claims.

Downhole operations may be performed in the stages 30 in a particular directional order or sequence, in accordance with example implementations. For example, in accordance with some implementations, downhole operations may be conducted in a direction from the toe end of the wellbore to the heel end of the wellbore 15. In further implementations, these downhole operations may be conducted in a direction from the heel end to the toe end of the wellbore 15. In accordance with further example implementations, the operations may be performed in no particular directional order or sequence.

FIG. 1A depicts that fluid communication with the surrounding hydrocarbon formation(s) has been enhanced through sets 40 of perforation tunnels that, for this example, are formed in each stage 30 and extend through the wall of the tubing string 20. It is noted that each stage 30 may have multiple sets of such perforation tunnels 40. Although perforation tunnels 40 are depicted in FIG. 1A, it is understood that other techniques may be used to establish/enhance fluid communication with the surrounding formation(s). As examples, fluid communication may be alternatively established using, for example, a jetting tool that communicates an abrasive slurry to perforate the tubing string wall; opening sleeve valves of the tubing string (as described below in connection with FIG. 2); and so forth.

Figure 1B:
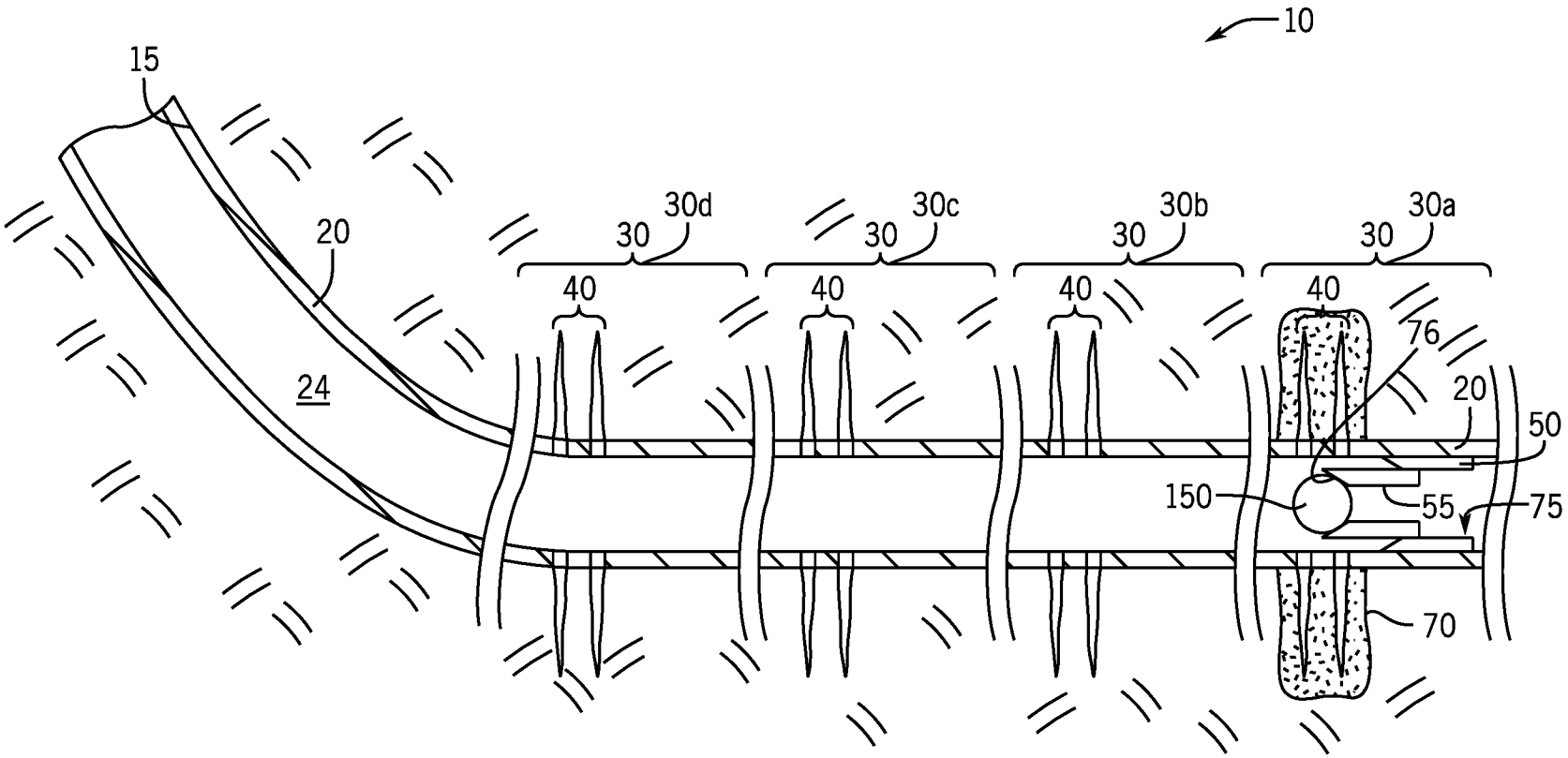
FIG. 1B is schematic diagram of the well of FIG. 1A illustrating use of an expandable downhole seat assembly to form a fluid barrier in a tubing string according to an example implementation.

Referring to FIG. 1B in conjunction with FIG. 1A, as an example, a stimulation operation may be performed in the stage 30*a* by deploying an expandable downhole seat assembly 75 (in its radially contracted state) into the tubing string 20 on a setting tool (as further disclosed herein); and in the stage 30*a*, the seat assembly 75 may be radially expanded to secure the seat assembly 75 to the tubing string 20.

As depicted in FIG. 1B, the downhole seat assembly 75 includes concentric rings: an inner ring 55 and an outer ring 50; and as depicted in FIG. 1B, in accordance with example implementations, the inner ring 55 may be located uphole of the outer ring 50. When the downhole seat assembly 75 is set inside the tubing string 20, as depicted in FIG. 1B, the outer ring 50 is correspondingly radially expanded to secure the ring 50 (and downhole assembly 75) to the tubing string 20. The inner ring 55 provides a seat to receive an untethered object (here, an activation sphere, or ball 150) to form a fluid tight obstruction, or barrier, to divert fluid in the tubing string 20 uphole of the barrier. Thus, for the example implementation of FIG. 1B, the fluid barrier may be used to divert fracturing fluid (pumped into the tubing string 20 from the Earth surface) into the stage 30*a*, as illustrated at reference numeral 70.

Figure 2:
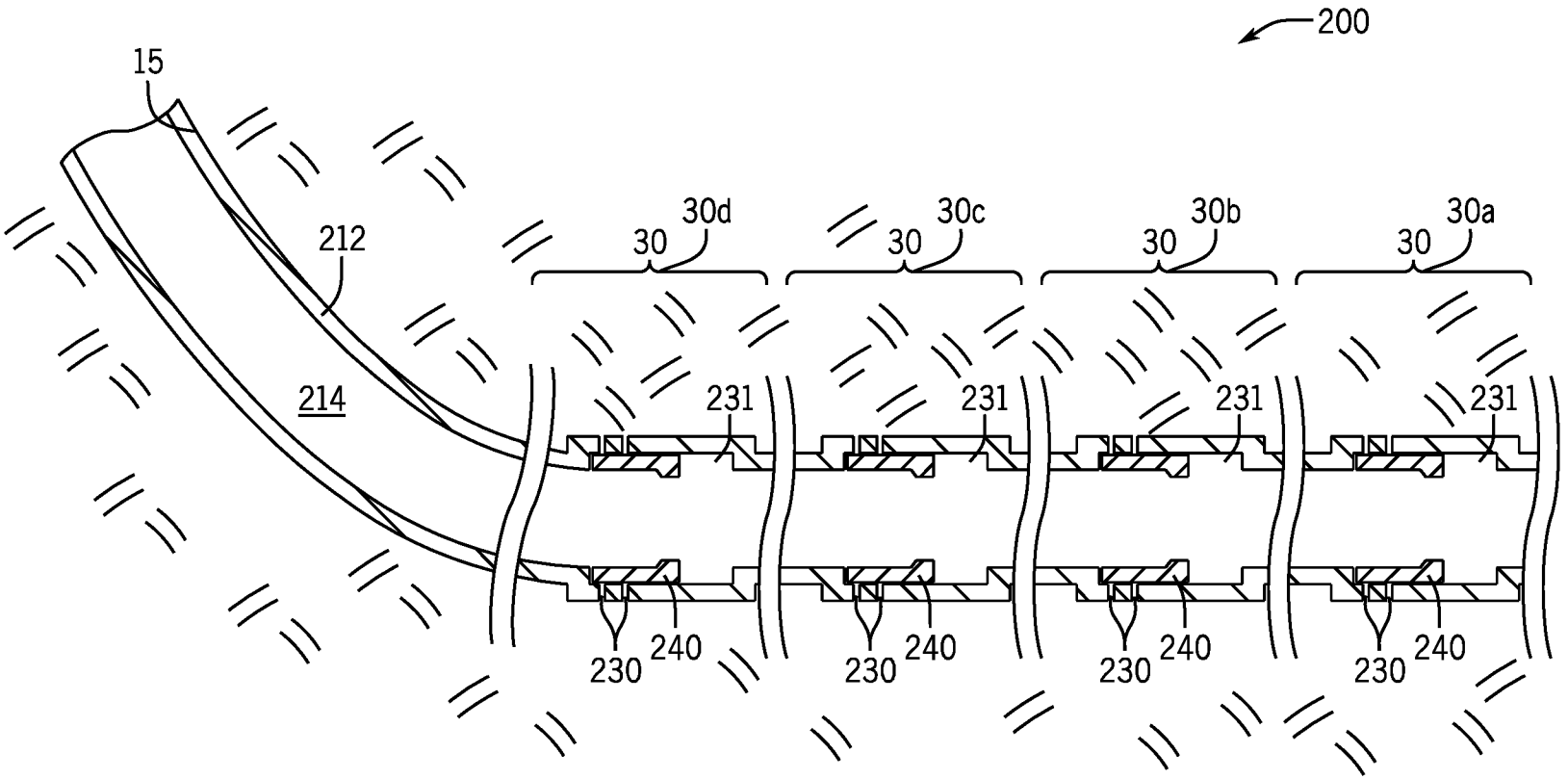
FIG. 2 is a schematic diagram of a well illustrating a casing string having sleeve valve assemblies according to an example implementation.

The downhole seat assembly 75 may be used in connection with a tubing string that contains valves, which are operated for purposes of selectively establishing fluid communication at particular locations of the tubing string. For example, FIG. 2 depicts an example tubing string 212 (a casing string, for example) of a well 200, which has a central passageway 214 and extends through associated stages 30*a*, 30*b*, 30*c* and 30*d* of the well 200. Each stage 30 has an associated sleeve valve assembly, which includes a sleeve 240. The sleeve 240, which resides in a recess 231 of the tubing string 212. For the state of the well 200 depicted in FIG. 2, the sleeve 240 is installed in the well in a closed state and therefore covers radial ports 230 in the tubing string wall. As an example, each stage 30 may be associated with a given set of radial ports 230, so that by communicating an activation ball (or other untethered object) downhole inside the passageway 214 of the tubing string 212 and landing the ball in a seat of a downhole seat assembly 75 (not shown in FIG. 2), a corresponding fluid barrier may be formed to divert fluid through the associated set of radial ports 230.

In this manner, the downhole seat assembly 75 may be run into the tubing string 212 and radially expanded into its radially expanded state for purposes of engaging one of the sleeves 240. The seat that is formed from the radially expanded downhole seat assembly 75 may then be used to catch an activation ball 150. Because of the force that is exerted by the activation ball 150, due to either the momentum of the ball 150 or a pressure differential created by the ball 150, the sleeve 240 may then be shifted downhole to reveal the associated radial ports 230. In this position, a fluid (fracturing fluid, for example) may be communicated into the associated stage 30.

Figures 3A, 3B, 3C:
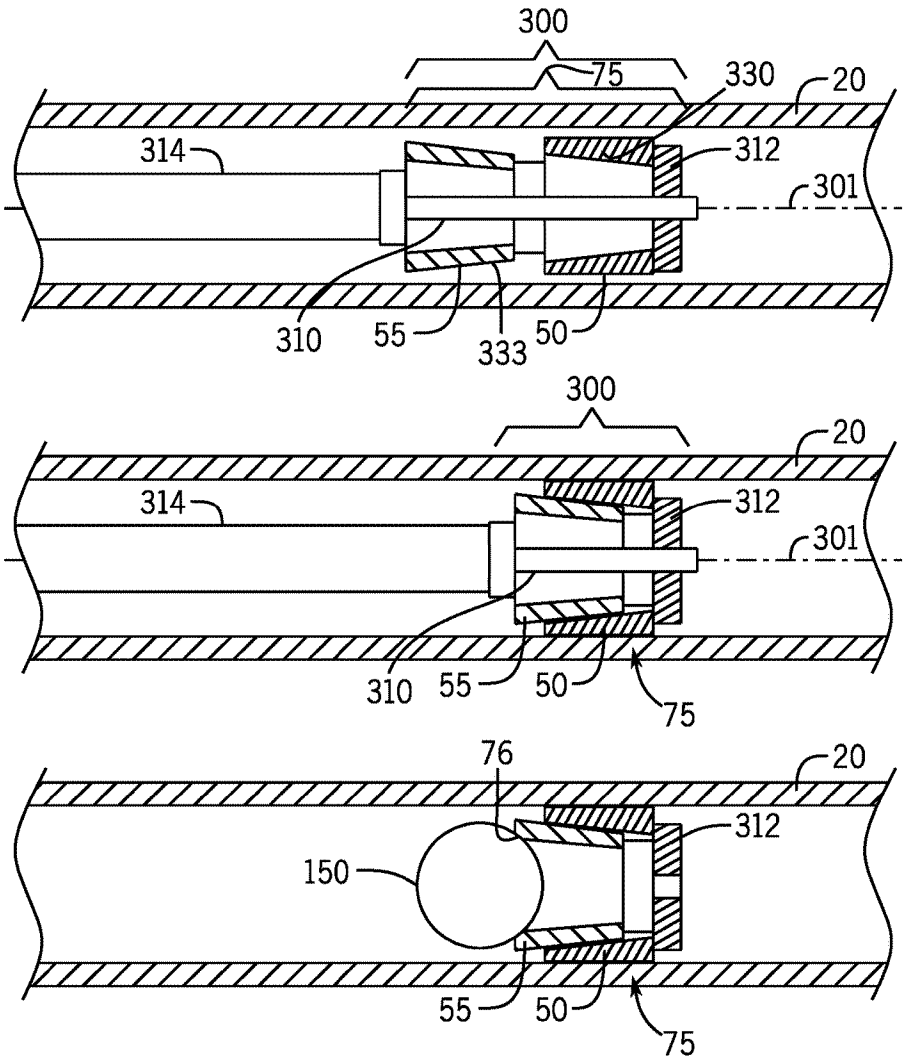
FIG. 3A is a schematic diagram illustrating the running of an expandable downhole seat assembly into a tubing string according to an example implementation.
FIG. 3B is a schematic diagram illustrating an operation to radially expand an outer ring of the downhole seat assembly to anchor the assembly to the tubing string according to an example implementation.
FIG. 3C is a schematic diagram illustrating creation of a fluid barrier in the tubing string using the downhole seat assembly and an activation ball according to an example implementation.

FIG. 3A depicts the running of the downhole seat assembly 75 downhole, in accordance with example implementations. In particular, FIG. 3A depicts a downhole assembly 300 that includes the downhole seat assembly 75 in its radially contracted state (its run-in-hole state) and a setting tool assembly that is used to transition the downhole seat assembly 75 to its radially expanded state. The downhole assembly 300 may be run downhole inside the central passageway of the outer tubing string 20 on a conveyance mechanism, such as illustrated tubing string 314 other conveyance mechanisms (slickline, wireline, and so forth). For the state of the downhole seat assembly 300 that is depicted in FIG. 3A, the outer ring 50 and the inner ring 55 each have a sufficiently small OD to freely pass through the central passageway of the tubing string 20.

In accordance with example implementations, an outer, tapered surface 333 of the inner ring 55 is shaped to be received inside an inner, tapered surface 330 of the outer ring 50 (when the outer ring 50 is contracted) for purposes of radially expanding the outer ring 50 to secure the ring 50 to the outer tubing string 20. More specifically, in accordance with example implementations, when the downhole assembly 300 is positioned at the appropriate target location inside the outer tubing string 20, a rod 310 of the assembly 300 may be pulled uphole to force the inner ring 55 inside the outer ring 50 to radially expand the outer ring 50, as depicted in FIG. 3B. In this manner, the rod 310 may be constructed to be translate along a longitudinal axis 301 of the string 20, with respect to the tubing string 314 and may be connected at its lower end to an anvil, or stop 312. As examples, the axial movement of the rod 310 to set the downhole seat assembly 75 may controlled using remotely communicated stimuli and a downhole actuator (an actuator responsive to tubing conveyed pressure, control line pressure, electrical signals, and so forth); may be controlled by mechanical movement of the string 314; and so forth.

After the downhole seat assembly 75 is anchored in position inside the outer tubing string 20, the setting tool may be disengaged from the assembly 75 and removed from the outer tubing string 20 to leave the assembly 75 downhole, as depicted in FIG. 3C. An untethered object, such as activation ball 150, may be deployed from the Earth surface inside central passageway of the outer tubing string 20 and travel until resting, or landing, in the seat 76 of the inner ring 55, as depicted in FIG. 3C, to create a corresponding downhole fluid barrier.

Figure 9:
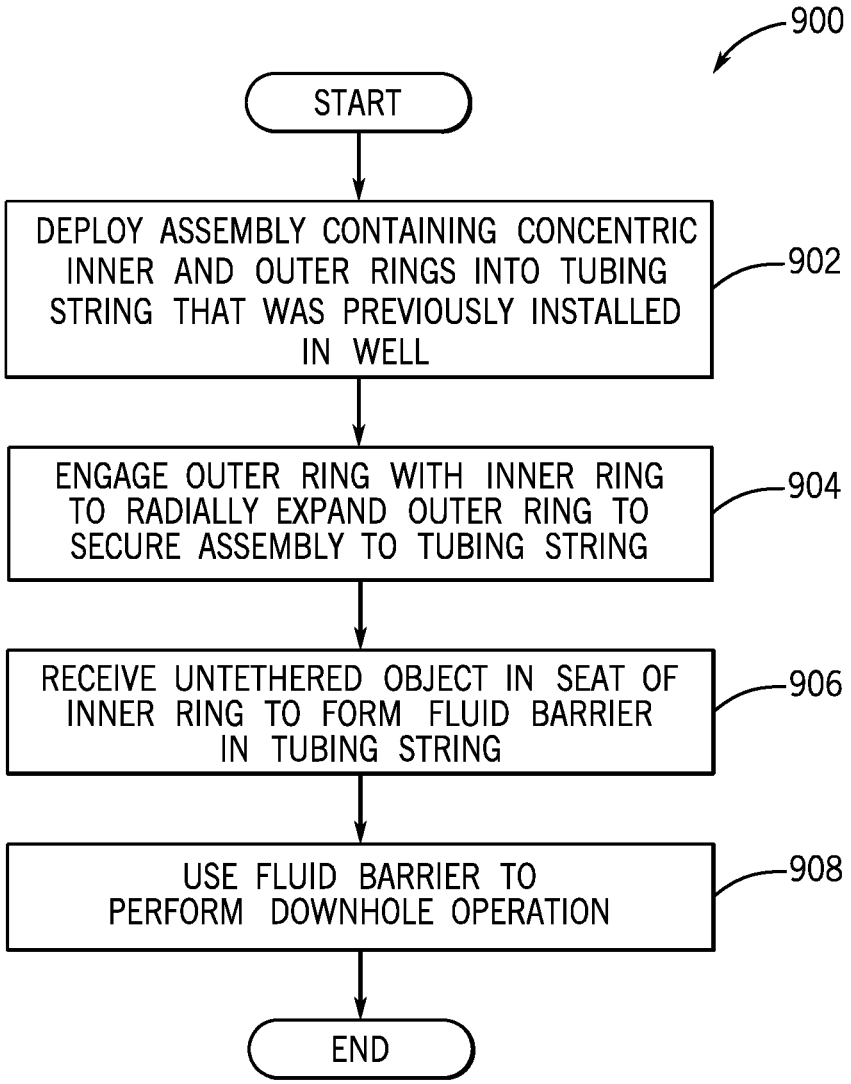
FIGS. 9, 12, 13, 15 and 16 are flow diagrams depicting techniques to deploy and use an expandable downhole seat assembly in a well according to example implementations.

Thus, referring to FIG. 9, in accordance with example implementations, a technique 900 includes deploying (block 902) an assembly that contains concentric inner and outer rings into a tubing string; and engaging (block 904) the outer ring with the inner ring to radially expand the outer ring to secure the assembly to the tubing string. The technique 900 includes receiving (block 906) an untethered object in a seat of the inner ring to form a fluid barrier and using (block 908) the fluid barrier to perform a downhole operation.

Figure 4:
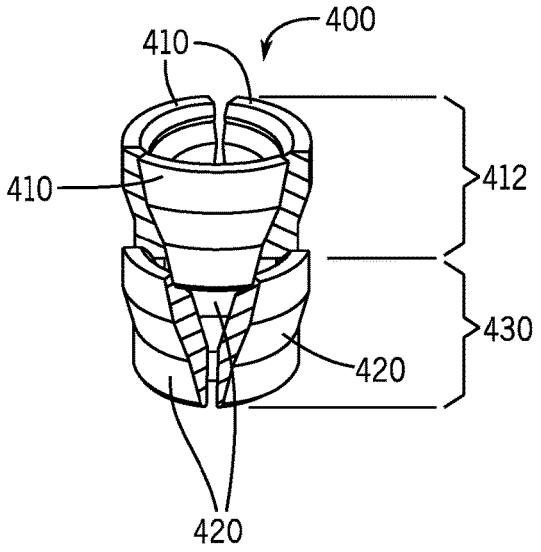
FIG. 4 is a perspective view of a segmented ring assembly in a radially contracted state according to an example implementation.
Figure 5:
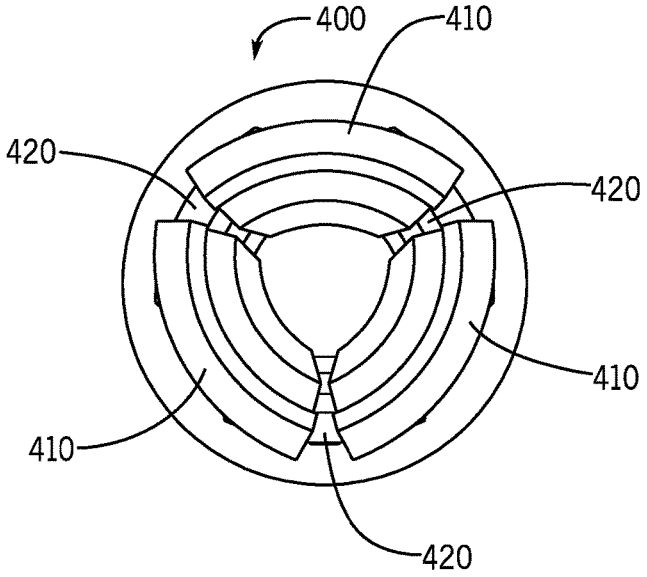
FIG. 5 is a top view of the segmented ring assembly of FIG. 4 according to an example implementation.
Figure 6:
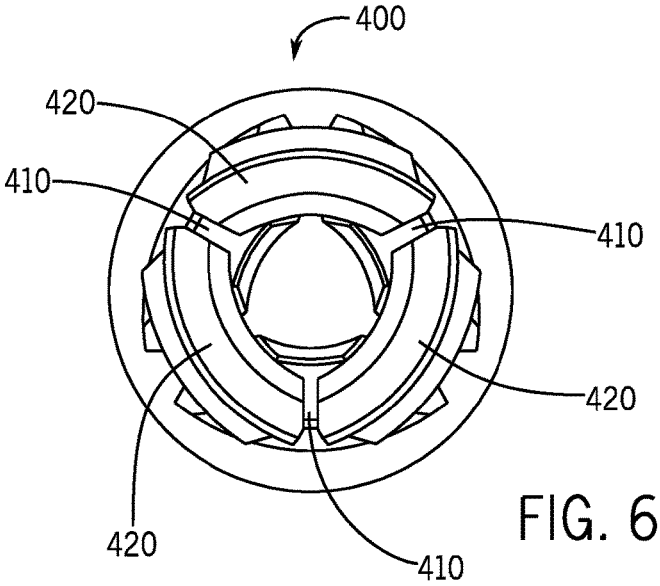
FIG. 6 is a bottom view of the segmented ring assembly of FIG. 4 according to an example implementation.

FIG. 4 depicts a perspective view of a segmented ring assembly 400, in accordance with example implementations. An assembly the same or similar to the segmented ring assembly 400 may be used for the inner ring 55 (see FIG. 3C), the outer ring 50 (see FIG. 3C) or for both the outer 50 and inner 55 rings, depending on the particular implementation. In this manner, the segmented ring assembly 400 may be sized appropriately, depending on whether the assembly 400 is used for the outer ring 50 or for the inner ring 55.

FIG. 4 depicts the segmented ring assembly 400 in a radially contracted state, i.e., in a radially collapsed state, which facilitates travel of the assembly 400 though the central passageway of a tubing string. For this example implementation, the segmented ring assembly 400 has two sets of curved segments: three upper segments 410; and three lower segments 420. In the contracted state, the segments 410 and 420 are radially contracted and are longitudinally, or axially, expanded into two layers 412 and 430.

The upper segment 410 is, in general, a curved wedge that has a radius of curvature about the longitudinal axis of the segmented ring assembly 400 and is larger at its top end than at its bottom end; and the lower segment 420 is, in general, a curved wedge that has the same radius of curvature about the longitudinal axis (as the upper segment) and is larger at its bottom end than at its top end. Due to the relative complementary profiles of the segments 410 and 420, when the segmented ring assembly 400 expands (i.e., when the segments 410 and 420 radially expand and the segments 410 and 420 axially contract), the two layers 412 and 430 longitudinally, or axially, compress into a single layer of segments such that each upper segment 410 is complimentarily received between two lower segments 420, and vice versa, as depicted in FIG. 7.

Figure 7:
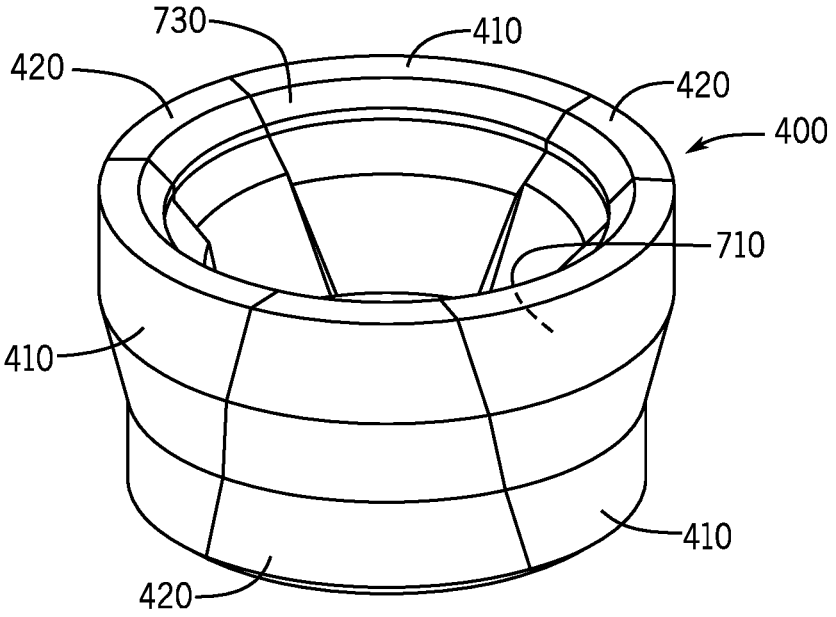
FIG. 7 is a perspective view of the segmented ring assembly in a radially expanded state according to an example implementation.
Figure 8:
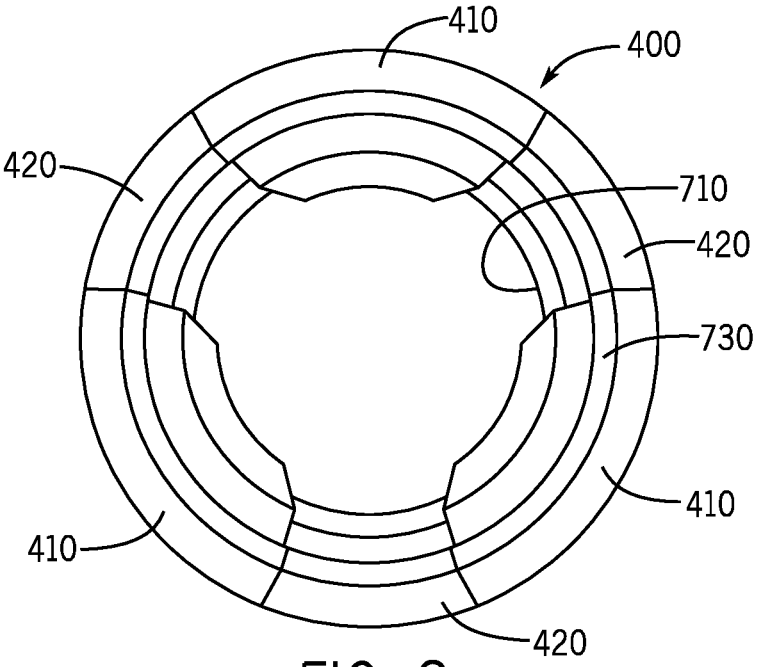
FIG. 8 is a top view of the segmented ring assembly of FIG. 7 according to an example implementation.

Referring to FIG. 7, in its expanded state, the segmented ring assembly 400, when used for the inner ring 55, provides a seat that is sized to catch an appropriately-sized object. More specifically, when used for the inner ring 55, an upper curved surface of each of the segments 410 and 420 forms a corresponding section of an annular seat surface 730 (i.e., an object catching seat) when the segmented ring assembly 400 is in its radially expanded state. As depicted in FIG. 8, the surface seat ring 730 circumscribes an opening 710 of the assembly 400, which is appropriately sized to control which smaller size objects to pass through the assembly 400 and which larger size objects land are caught by the assembly 400.

Figure 10:
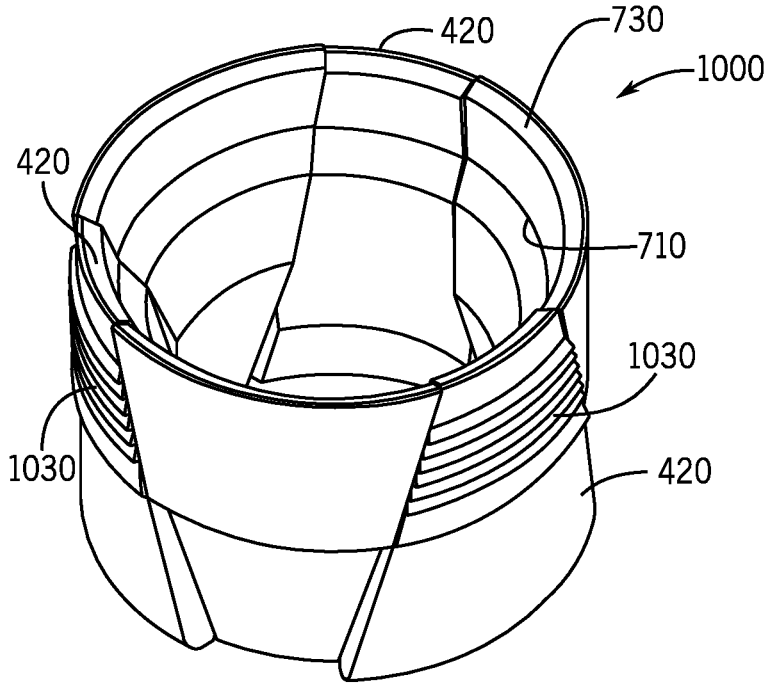
FIG. 10 is a perspective view of a segmented ring assembly according to a further example implementation.

A segmented ring assembly 1000 of FIG. 10 may be used in place of the segmented ring assembly 400 for example implementations in which the assembly 1000 is used for the outer ring 50. Referring to FIG. 10, the segmented ring assembly 1000 shares similar features with the segmented ring assembly 400, with similar reference numerals being used to depict similar elements. Unlike the segmented ring assembly 400, the segments 420 of the segmented ring assembly 1000 have exterior teeth 1030. In this manner, the teeth 1030 are disposed on the outer surface of the segment 420 for purposes of extending, or biting, into the wall of the surrounding tubing string to enhance the anchoring of the segmented ring assembly 1000 to the tubing string.

In accordance with further example implementations, when used for the outer ring, a segmented ring assembly may be coated with a material to enhance adherence of the assembly to the inner wall of the tubing string 20. Moreover, in accordance with further example implementations, the outer ring 50 may have an exterior surface finish that enhances the adherence of the ring 50 to the tubing string wall. In this manner, the outer surface of the outer ring 50 may have a relatively unsmooth or rough finish, as compared to the interior surface of the outer ring 50 and surfaces of the inner ring 55, for example.

Giving that the seat of the seat assembly has to withstand a differential pressure (called "P") for a casing diameter (called "D"), the net axial force (called "Fa") acting on the seat may be described as follows:

$$F\alpha=0.25\pi D^2P. \quad \text{Eq.1}$$

For a friction coefficient (called "fc1") between the outer ring surface and the outer tubing string, the minimum radial contact force (called "Fr") pressing the outer ring 50 against the tubing string wall may be described as follows:

$$Fr = 0.25\pi D^2 \frac{P}{fc1}. \quad \text{Eq. 2}$$

The radial contact stress (called "Srr") acting between the outer ring 50 and the tubing string may be described as follows:

$$Srr = 0.25\frac{PD}{fc1L}, \quad \text{Eq. 3}$$

where "L" represents the length of the outer surface of the outer ring 50 in contact with the outer tubing string. The L length and the fc1 friction may be chosen so that the resulting Srr radial force does not cause the outer tubing string to yield. In general, the larger the fc1 friction, the smaller the stress.

Regarding the contacting mating surfaces of the outer 50 and inner 55 rings, the friction coefficient (called "fc2") and the conical angle (called the wedge angle, or θ wedge angle) of the mating surfaces may be selected, in accordance with example implementations, to self-lock the outer 50 and inner 55 rings in place when the setting tool pressing the rings 50 and 55 together is removed. Otherwise, as the setting tool is removed, the inner ring 55 may slide from inside the outer ring 50. Constructing this self-locking feature essentially means that, in accordance with example implementations, the fc2 friction coefficient between the two mating surfaces is greater than the tangent of the θ wedge angle:

$$fc2>\tan(\theta). \quad \text{Eq. 4}$$

Eq. 4 therefore defines a lower bound on the fc2 friction coefficient, in accordance with example implementations.

In accordance with example implementations, a second constraint is imposed, which relates the fc2 friction component to the minimum axial force (called "ToolF") to be exerted by the setting tool to push the inner 55 and outer 50 rings together in order to achieve the Fr minimum radial contact force that is described in Eq. 2 above. The relationship between the ToolF and Fr forces may be described as follows:

$$\text{Tool}_F = Fr\frac{\sin(\theta) + fc2\cos(\theta)}{\cos(\theta) - fc2\sin(\theta)}. \quad \text{Eq. 5}$$

The greater the value of the fc2 friction coefficient, the larger the $Tool_F$ minimum tool force. Therefore, the force that the setting tool can generate imposes an upper bound on "fc2". In accordance with example implementations, the θ wedge angle may 2 to 6 degrees. Other wedge angles may be used, in accordance with further implementations.

Referring back to FIG. 3C, in accordance with example implementations, the inner ring 55 and the outer ring 50 may both be segmented ring assemblies (as an example, the assemblies 400 and 1000 may be used for the inner ring 55 and outer ring 50, respectively). Moreover, the inner ring 55 may be a segmented ring assembly that is radially expanded by a setting tool, which transitions the inner ring 55 between its retracted and expanded states.

Figure 11A:
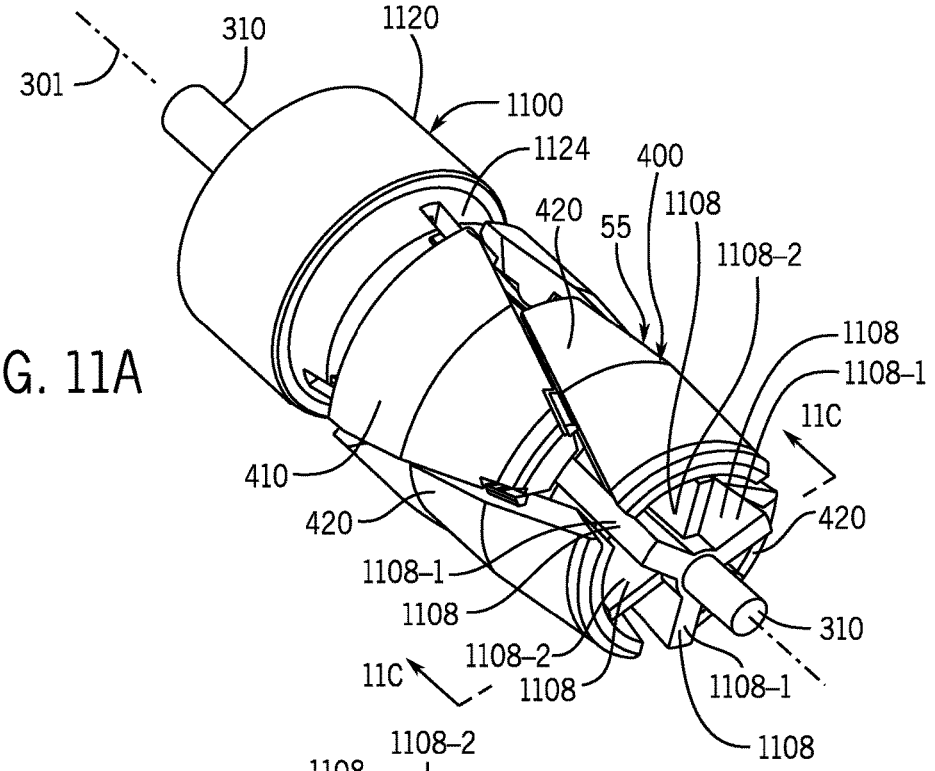
FIG. 11A is a perspective view of a setting tool assembly and an inner segmented ring assembly of the downhole seat assembly according to an example implementation.

More specifically, referring to FIG. 11A, in accordance with an example implementation, a setting tool 1100 may be used to transition the inner ring 55 (here, a segmented ring assembly 400) between its radially contracted and expanded states. The setting tool 1100 includes components that move relative to each other to expand the inner ring 55: a rod 310 and a mandrel 1120, which generally circumscribes the rod 310. The relative motion between the rod 310 and the mandrel 1120 causes surfaces of the mandrel 1120 and rod 310 to contact the upper 410 and lower 420 segments of the inner ring 55 for purposes of radially expanding the segments 410 and 420 and longitudinally contracting the segments into a single layer, as described above (see FIG. 7).

As depicted in FIG. 11A, the rod 310 and mandrel 1120 are generally concentric with the longitudinal axis 301 (see also FIG. 3A) and extend along the longitudinal axis 301. An upper end 1112 of the rod 310 may be attached to the tubing string 314 (see also FIG. 3A) or other conveyance mechanism, and a bottom end 1110 of the rod 310 may be attached to the stop 312, as depicted in FIG. 3C.

Figure 11B:
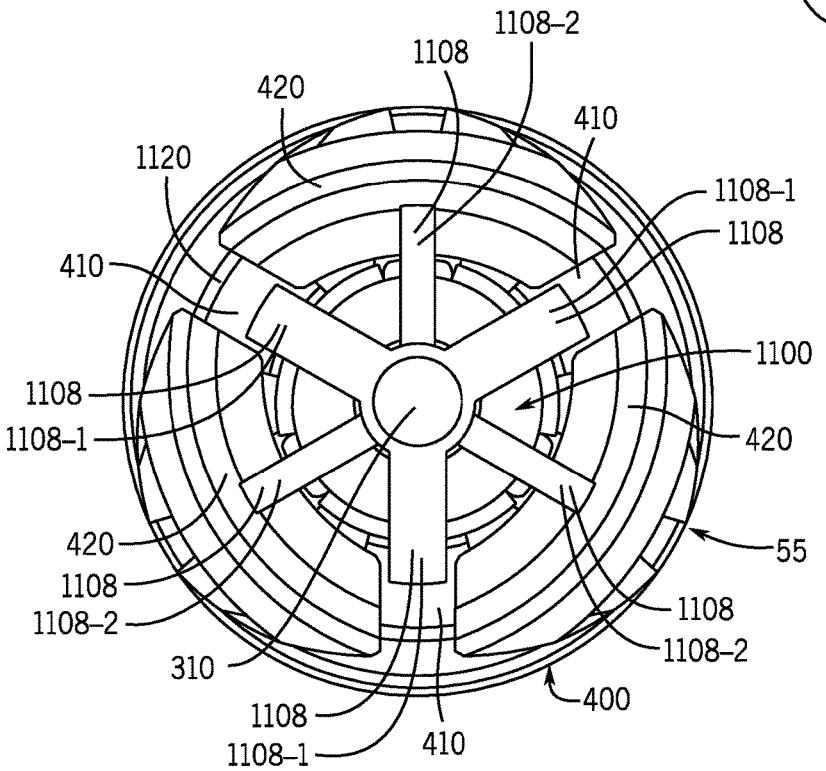
FIG. 11B is a bottom view of the setting tool and segmented ring assemblies of FIG. 11A according to an example implementation.

Referring to FIG. 11B in conjunction with FIG. 11A, in accordance with example implementations, in general, the rod 310 has radially extending vanes 1108 for purposes of contacting inner surfaces of the ring assembly segments 410 and 420: vanes 1108-1 to contact the upper segments 410; and vanes 1108-2 to contact the lower segments 420. For the specific example implementation that is illustrated in FIGS. 11A and 11B, the setting tool 1100 includes six vanes 1108, i.e., three vanes 1108-1 contacting for the upper segments 410 and three vanes 1108-2 for contacting the lower segments 420. Moreover, as shown, the vanes 1108 may be equally distributed around the longitudinal axis 301, in accordance with example implementations. Although the examples depicted herein show two layers of three segments, it is noted that an infinite possibility of combinations with additional layers or with a number of segments per layer may be used (combinations of anywhere from two to twenty for the layers and segments, as examples) and contemplated and are within the scope of the appended claims.

Figure 11C:
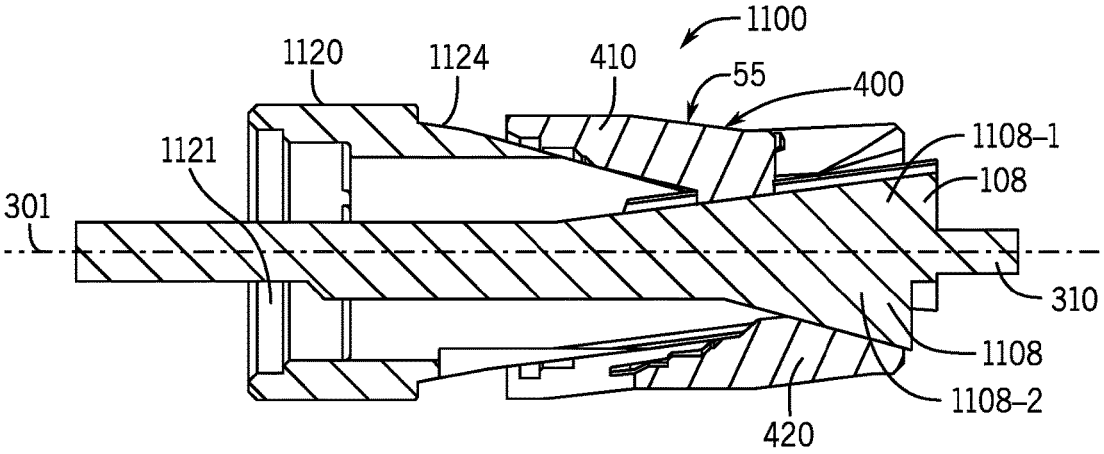
FIG. 11C is a cross-sectional view taken along line 11C-11C of FIG. 11A according to an example implementation.

Referring to FIG. 11C, relative motion of the rod 310 relative to the mandrel 1120 longitudinally compresses the segments 410 and 420 along the longitudinal axis 301, as well as radially expands the segments 410 and 420. This occurs due to the contact between the segments 410 and 420 with the inclined faces of the vanes 1108, such as the illustrated incline faces of the vanes 1108-1 and 1108-2 contacting inner surfaces of the segments 410 and 420, as depicted in FIG. 11C.

Figure 12:
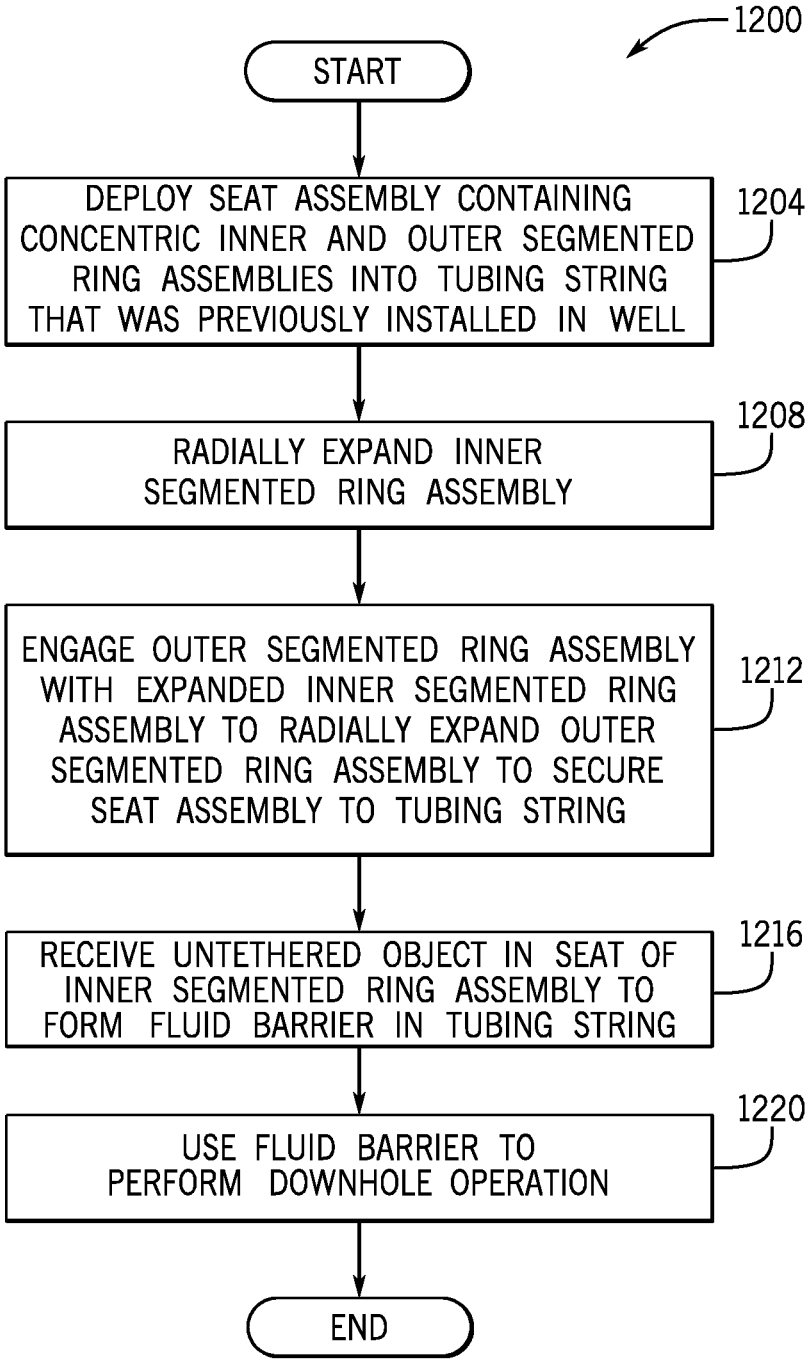

As noted above, in accordance with some implementations, the inner ring 55 and the outer ring 50 may both be segmented ring assemblies. Therefore, referring to FIG. 12, in accordance with example implementations, a technique 1200 includes deploying (block 1204) a seat assembly into a tubing string, which was previously installed in a well. The seat assembly contains concentric inner and outer segmented ring assemblies. Upon reaching the appropriate downhole position, the inner segmented ring assembly is first radially expanded (block 1208); and the expanded, inner segmented ring assembly is then axially translated to engage the outer segmented ring assembly to radially expand the outer segmented ring assembly to secure the seat assembly to the tubing string, pursuant to block 1212. The technique 1200 includes receiving (block 1216) an untethered object in a seat of the inner segmented ring assembly to form a fluid barrier and using (block 1220) the fluid barrier to perform a downhole operation.

Figure 13:
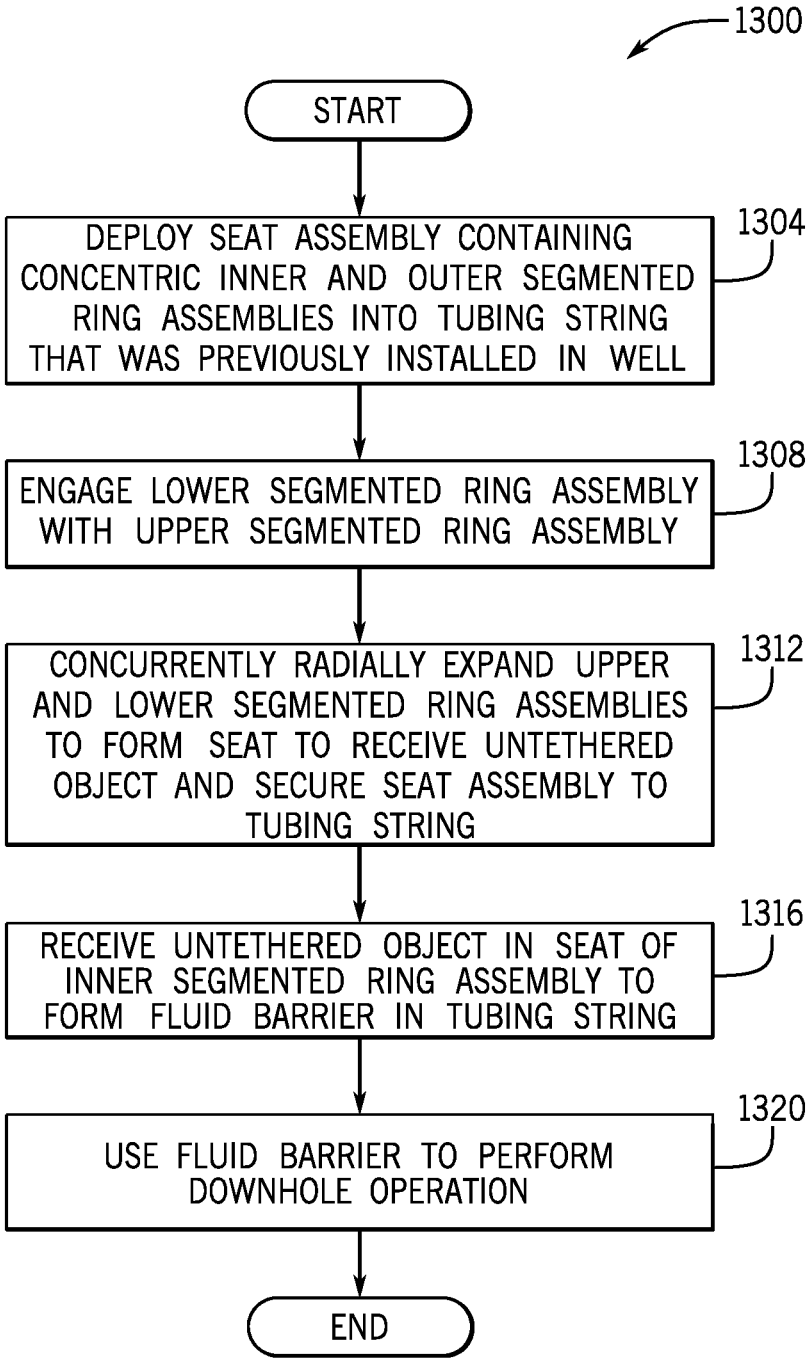

In accordance with some implementations, the inner 55 and outer 50 rings may both be segmented ring assemblies; and the inner ring 55 may be first be longitudinally translated to engage the outer ring 50 so that the inner 55 and outer 50 rings may be concurrently radially expanded together. More specifically, referring to FIG. 13, in accordance with example implementations, a technique 1300 includes deploying (block 1304) a seat assembly into a tubing string, which was previously installed in a well. The seat assembly contains concentric inner and outer segmented ring assemblies. Upon reaching the appropriate downhole position, the inner segmented ring assembly is moved into the outer segmented ring assembly (block 1308). The upper and lower segmented ring assemblies are then radially concurrently expanded together to form a seat to receive an untethered object and secure the seat assembly to the tubing string, pursuant to block 1312. The technique 1200 includes receiving (block 1316) an untethered object in the seat of the inner segmented ring assembly to form a fluid barrier and using (block 1320) the fluid barrier to perform a downhole operation.

Figure 14:
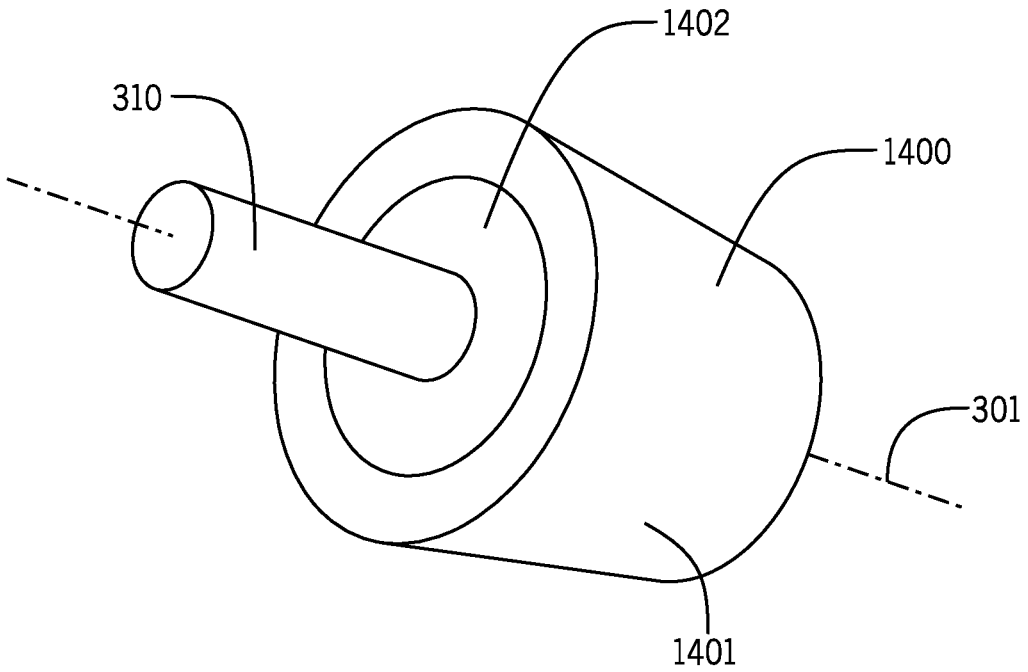
FIG. 14 perspective view of a setting tool assembly and a monolithic inner ring of the downhole seat assembly according to a further example implementation.

In accordance with further example implementations, the inner ring 55 may be a single piece, continuous ring (i.e., a monolithic ring) that has a fixed OD. In this manner, FIG. 14 depicts a continuous ring 1400 that may be used for the inner ring 55, in accordance with example implementations. As shown in FIG. 14, the continuous ring 1400 may be conical, or tapered, and may be mounted on a tapered mandrel 1402. The mandrel 1402 is connected to the rod 310, and the rod 310 (see also FIG. 3A) may be moved for purposes of engaging the outer ring 50 with the ring 1400. As shown, in accordance with example implementations, the ring 1400 has a tapered, outer surface 1401, which corresponds to the inner surface 330 (see FIG. 3A) of the outer ring 50 when the ring 50 is radially contracted.

Figure 15:
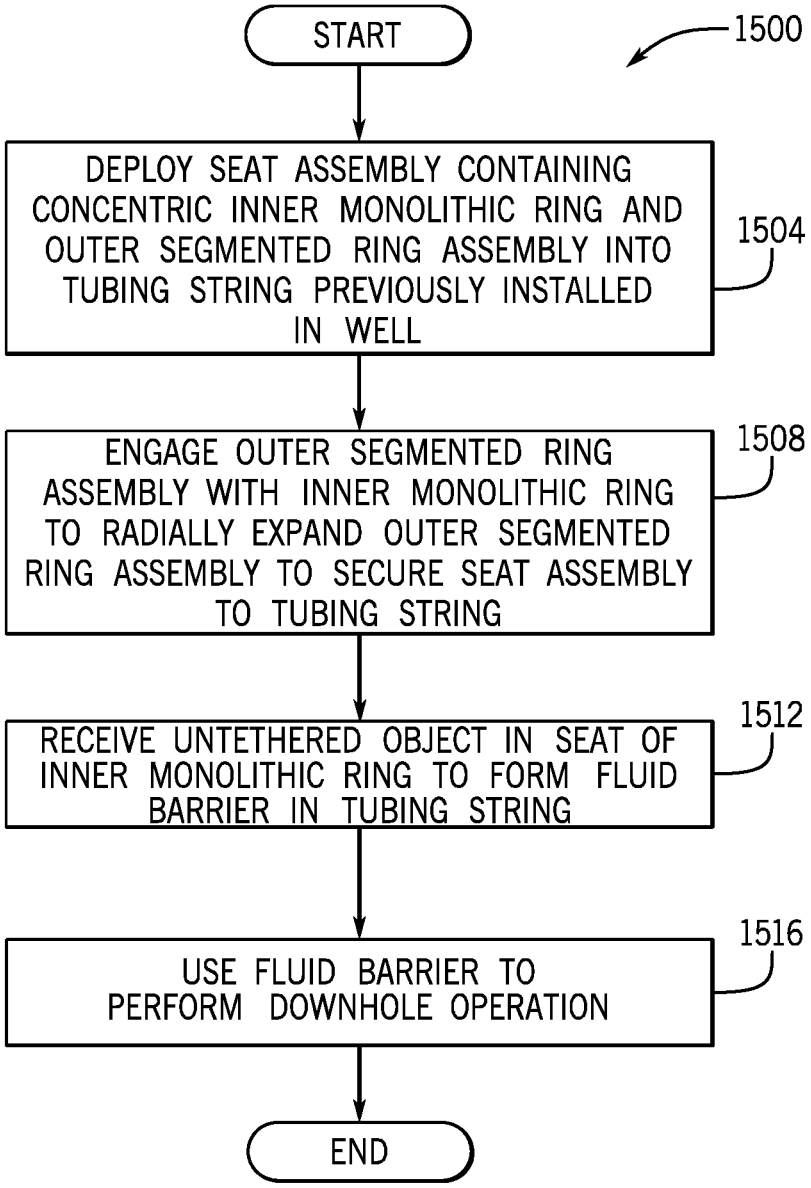

Thus, referring to FIG. 15, in accordance with example implementations, a technique 1500 includes deploying (block 1504) a seat assembly into a tubing string, which was previously installed in a well. The seat assembly contains concentric rings: an inner, continuous ring and an outer, segmented ring assembly. Upon reaching the appropriate downhole position, the outer, segmented ring assembly is engaged (block 1508) with the inner, continuous ring to radially expand the outer, segmented ring assembly to secure the downhole seat assembly to the tubing string. Pursuant to the technique 1500, an untethered object may then be received (block 1512) in a seat of the inner, continuous ring to form a fluid barrier in the tubing string; and the fluid barrier may be used (block 1516) to perform a downhole operation.

In accordance with example implementations, one or more components of the downhole seat assembly may contain a material or materials, which allow at least part of the assembly to be dissolved by well fluid or other fluid, which is introduced into the tubing string passageway in which the assembly is disposed. In this manner, the fluid barrier may be removed by dissolving the inner ring 55, outer ring 50 and/or activation ball (or other untethered object) with a fluid that is present downhole. As an example, dissolvable, or degradable, materials may be used similar to the materials disclosed in the following patents, which have an assignee in common with the present application and are hereby incorporated by reference: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

In this context, a dissolvable or degradable material is a material that degrades at a significantly faster rate than other materials or components (the tubing string 20, for example) of the downhole well equipment. For example, in accordance with some implementations, dissolvable or degradable material(s) may be used for the downhole seat assembly and/or untethered object, which degrade at sufficiently fast rate to allow the fluid barrier to disappear (due to the material degradation) after a relatively short period of time (a period less than one year, a period less than six months, or a period of less than ten weeks, as just a few examples). In this manner, the fluid barrier maintains its integrity for a sufficient time to allow the downhole operation(s) that rely on the fluid barrier to be performed, while disappearing shortly thereafter to allow other operations to proceed in the well, which rely on access through the portion of the tubing string, which contained the fluid barrier.

Other implementations are contemplated, which are within the scope of the appended claims. For example, in accordance with further implementations, the inner and outer rings of a downhole seat assembly may engage each other to press the outer ring into the tubing string wall after both rings have been radially expanded. As an example, the inner ring may be a monolithic ring, and the outer ring may be a segmented ring assembly that is fitted on a setting tool that is constructed to radially expand the outer ring, similar to the setting tool 1100 that is described above. In accordance with this implementation, after the downhole seat assembly is run to the target downhole location, the setting tool may first be used to axially contract the outer ring (the segmented ring assembly) to cause the outer ring to radially expand; and then the setting tool may be actuated to push the monolithic inner ring inside the now expanded outer ring to press the outer ring against the tubing string wall. In accordance with further example implementations, the inner ring may also be a segmented ring assembly, which is also radially expanded by a setting tool before engaging the outer ring.

Figure 16:
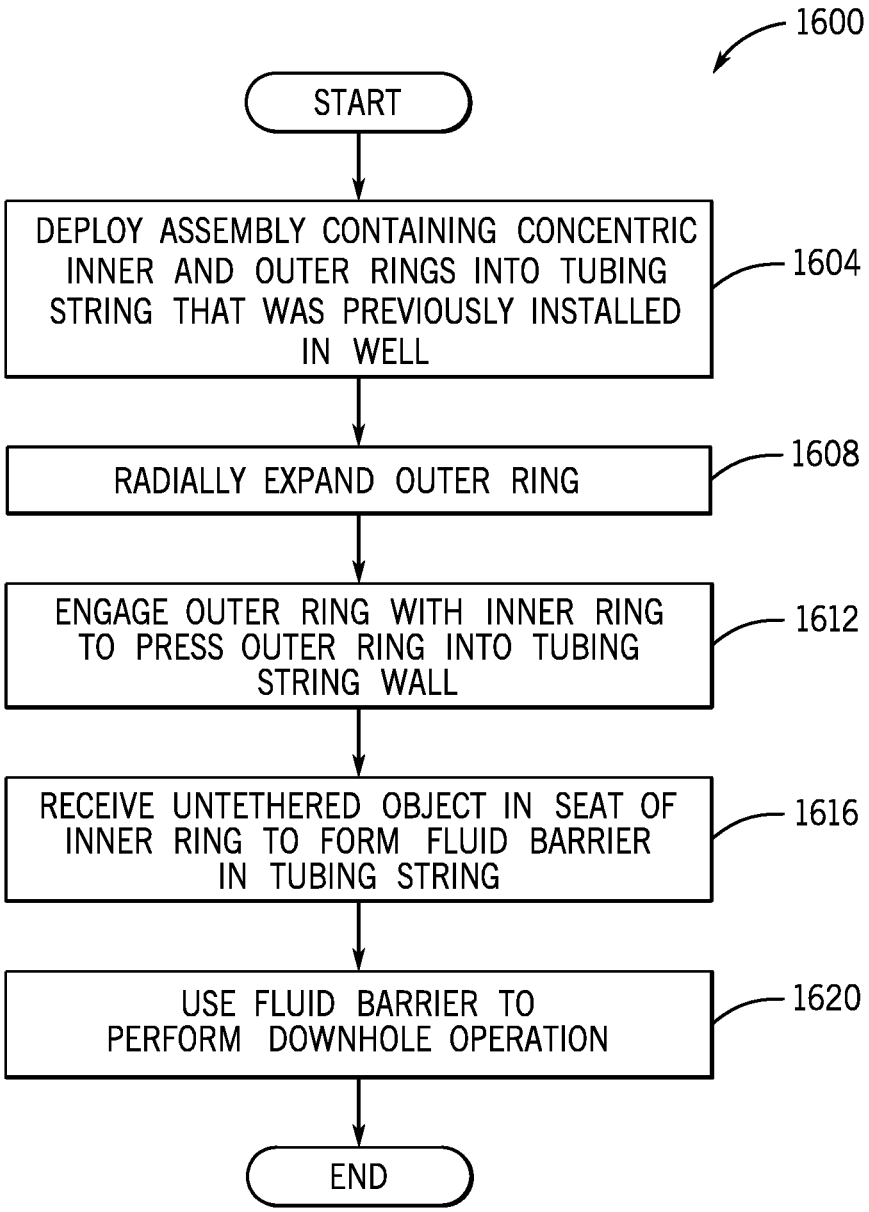

Referring to FIG. 16, thus, in accordance with example implementations, a technique 1600 includes deploying (block 1604) an assembly that contains concentric inner and outer rings into a tubing string; and radially expanding (block 1608) the outer ring. The technique 1600 includes subsequently engaging (block 1612) the outer ring with the inner ring to press the outer ring into the tubing string wall. The technique 1600 includes receiving (block 1616) an untethered object in a seat of the inner ring to form a fluid barrier and using (block 1620) the fluid barrier to perform a downhole operation.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

deploying an assembly into a previously installed tubing string, the assembly comprising a first ring and a second ring concentric with the first ring, engaging the first ring with the second ring to press the first ring into the tubing string to secure the assembly to the string, wherein an inner surface of the first ring and an outer surface of the second ring comprise contacting mating surfaces having a same conical angle, and wherein a friction coefficient between the inner surface of the first ring and the outer surface of the second ring is greater than a tangent of the conical angle;

receiving an untethered object in a seat of the second ring to form a fluid barrier; and using the fluid barrier to perform a downhole operation.

2. The method of claim 1, wherein the first ring comprises a segmented ring assembly, and engaging the first ring with the second ring comprises using the second ring to radially expand the first ring.

3. The method of claim 2, wherein:

deploying the assembly into the tubing string comprises running the assembly into the string with a setting tool assembly and with the first ring being configured in a contracted state;

the first ring comprises segments adapted to, in the contracted state of the first ring, be radially contracted and be arranged in a first number of layers along a longitudinal axis of the assembly; and engaging the first ring with the second ring comprises operating the setting tool assembly to move the second ring inside the first ring.

4. The method of claim 2, wherein engaging the first ring with the second ring comprises:

engaging an interior surface of the first ring with the second ring to radially expand the first ring.

5. The method of claim 1, wherein:

deploying the assembly into the string comprises running a tool into the well; and engaging the first ring with the second ring comprises operating the tool to push the second ring into the first ring.

6. The method of claim 1, further comprising dissolving at least one of the untethered object, the first ring, and the second ring to remove the fluid barrier.

7. The method of claim 1, wherein the first ring comprises a segmented ring assembly, the method further comprising:

radially expanding the first ring; and engaging the first ring with the second ring after the radial expansion of the first ring.

8. The method of claim 1, wherein the second ring is monolithic.

9. An apparatus usable with a well, comprising:

an inner ring comprising a seat to receive an untethered object;

an outer ring concentric with the inner ring, wherein an inner surface of the outer ring and an outer surface of the inner ring comprise contacting mating surfaces having a same conical angle, and wherein a friction coefficient between the inner surface of the outer ring and the outer surface of the inner ring is greater than a tangent of the conical angle; and a tool assembly to, downhole in the well, engage the outer ring with the inner ring to press the outer ring into a wall of a tubing string to secure the outer ring to the tubing string.

10. The apparatus of claim 9, wherein the outer ring comprises a segmented ring assembly.

11. The apparatus of claim 9, wherein the setting tool assembly is adapted to axially translate the inner ring into the outer ring to radially expand the outer ring.

12. The apparatus of claim 9, wherein the setting tool assembly is adapted to axially translate the inner ring to engage the outer ring to radially expand the outer ring.

13. The method of claim 9, wherein the inner ring is monolithic.

14. A system usable with a well, comprising:

a tubing string; and an assembly comprising a setting tool and an expandable downhole seat assembly, wherein:

the downhole seat assembly is adapted to be run downhole inside a central passageway of the tubing string in a radially contracted state of the downhole seat assembly;

the downhole seat assembly comprises a monolithic inner ring and an outer segmented ring assembly concentric with the inner ring;

the setting tool assembly is adapted to axially translate the monolithic inner ring into the outer segmented ring assembly to, downhole in the well, radially expand the outer segmented ring assembly to secure the downhole seat assembly to the tubing string, wherein an inner surface of the outer segmented ring assembly and an outer surface of the monolithic inner ring comprise contacting mating surfaces having a same conical angle, and wherein a friction coefficient between the inner surface of the outer segmented ring assembly and the outer surface of the monolithic inner ring is greater than a tangent of the conical angle; and the monolithic inner ring comprises a seat to receive an untethered object to form a downhole fluid barrier in the tubing string.

15. The system of claim 14, wherein the tubing string comprises a plurality of sleeve valve assemblies, and the downhole fluid barrier diverts fluid through radial ports of a given sleeve valve of the plurality of sleeve valves.

16. The system of claim 14, wherein the setting tool assembly is adapted to be released from the downhole seat assembly after radial expansion of the outer segmented ring assembly.

17. The system of claim 14, wherein the downhole fluid barrier diverts fluid in the tubing string in connection with a hydraulic fracturing operation.

18. The system of claim 14, wherein:

the outer segmented ring assembly comprises segments adapted to, in a contracted state of the outer segmented ring assembly, be radially contracted and be longitudinally expanded into two layers; and the segments are adapted to, in a radially expanded state of the outer segmented ring assembly, be radially expanded and longitudinally contracted into a single layer.

* * * * *